US005902197A

United States Patent [19]

Davis et al.

[11] Patent Number: 5,902,197

[45] Date of Patent: May 11, 1999

[54] FOLDABLE PORTABLE BASKETBALL GOAL ASSEMBLY

[75] Inventors: Mark Davis, Wauwatosa; Ronald A. White, N. Prairie, both of Wis.

[73] Assignee: Huffy Corporation, Miamisburg, Ohio

[21] Appl. No.: 09/076,722

[22] Filed: May 13, 1998

[51] Int. Cl.[6] ..... A63B 63/08

[52] U.S. Cl. ..... 473/479

[58] Field of Search ..... 473/479, 447, 473/472, 480, 481, 482, 483, 484, 485, FOR 100, FOR 101, 486

[56] References Cited

U.S. PATENT DOCUMENTS

| | | | |
|---|---|---|---|
| 2,881,003 | 4/1959 | Drew . | |
| 4,526,367 | 7/1985 | Haston et al. . | |
| 4,869,501 | 9/1989 | Anastasakis | 473/483 |
| 4,946,163 | 8/1990 | Aacre et al. | 473/483 |
| 5,098,092 | 3/1992 | Aakre et al. . | |
| 5,154,414 | 10/1992 | Auer et al. | 473/486 |
| 5,259,612 | 11/1993 | Matherne et al. . | |
| 5,377,976 | 1/1995 | Matherne et al. | 473/483 |
| 5,390,914 | 2/1995 | Schroeder | 473/483 |
| 5,415,393 | 5/1995 | Fitzsimmons et al. . | |
| 5,478,068 | 12/1995 | Schroeder . | |
| 5,730,668 | 3/1998 | Hege et al. | 473/472 |

FOREIGN PATENT DOCUMENTS 2234-492 2/1973 Germany .

*Primary Examiner*—William H. Grieb

*Attorney, Agent, or Firm*—Howrey & Simon; Michael J. Bell; Erik B. Milch

[57] ABSTRACT

A portable basketball goal assembly that includes a rim attached to a backboard bracket. The backboard bracket is attached to a basketball backboard. The rim is pivotal in a direction towards the basketball backboard. The backboard is attached to one end of a shaft that contains foldable elements. The other end of the shaft is pivotally attached to the rear end of a base. A shaft support element has one end pivotally attached to the front end of the base. The other end of the shaft support element is removably attached to the shaft. The shaft and the shaft support element can be folded towards the base to allow storage and portability of the basketball goal. The base includes one or more wheels along its front edge allowing for transportability of the folded assembly. The basketball goal assembly can be stored in either a horizontal position parallel to the ground, or a vertical position perpendicular to the ground.

33 Claims, 6 Drawing Sheets

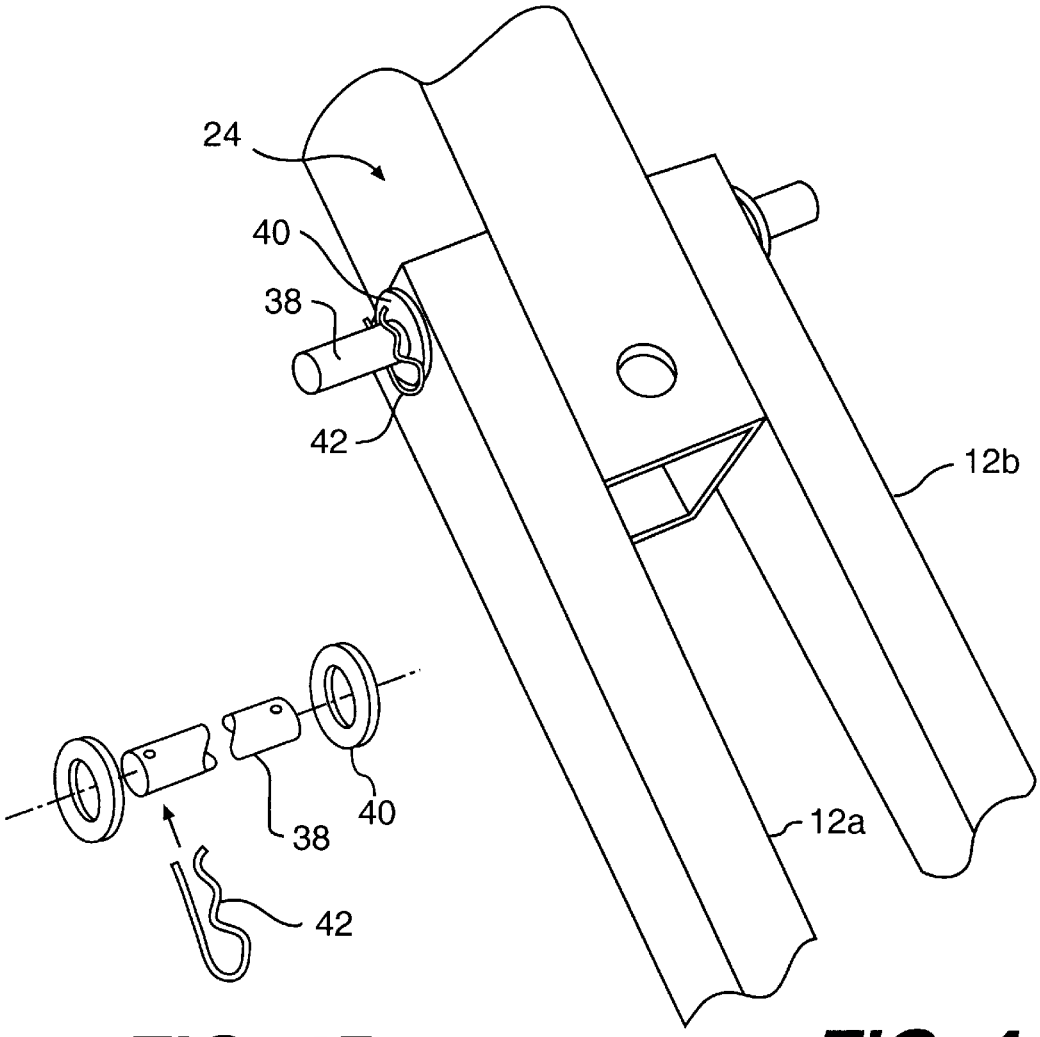
FIG. 4B
FIG. 4A
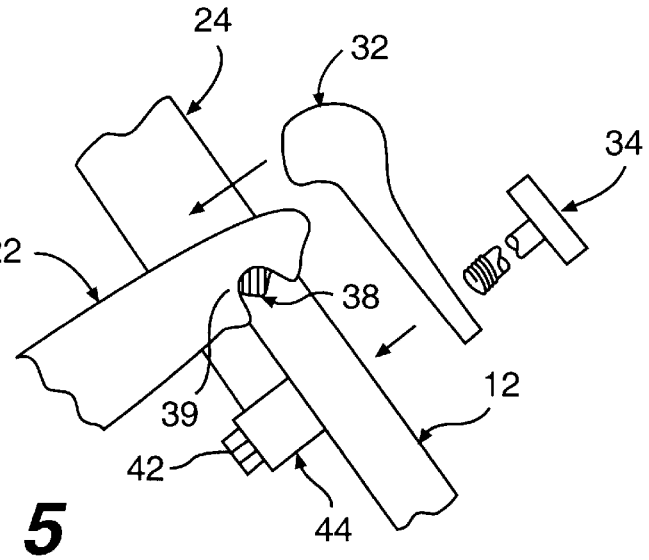
FIG. 5

FOLDABLE PORTABLE BASKETBALL GOAL ASSEMBLY

BACKGROUND OF THE INVENTION

1. Field of the Invention

The present invention relates in general to basketball goals, and more particularly, to portable basketball goals.

2. Description of the Related Art

The growing popularity of the sport of basketball has influenced many people to purchase basketball goals to allow playing of the sport around their own home. Traditionally, these basketball goals consist of a pole or shaft that is permanently anchored in some fashion, and a backboard-rim assembly attached to the shaft. Once installed, however, these basketball goals are difficult to remove for reinstallation elsewhere, and thus are generally not moved. This presents a problem if a person later desires to relocate the basketball goal assembly for some reason, such as to put something else where the basketball goal assembly currently exists. Another problem may exist if a person does not have enough space for a permanent basketball goal assembly.

Portable basketball goal assemblies, whereby the shaft is not in any fixed structure, but is set on a base that is movable, have thus become available. These portable basketball goal assemblies usually allow a person to move the basketball goal assembly from one place to another. These goals, however, are big and bulky to move. Moreover, many of these goals are not easily transported more than a short distance since they are usually moved in their upright playing position. If they are moved to a location, they are usually left there until relocated since these basketball goals are not easily stored.

Portability does not necessarily make for good storage. A basketball goal assembly in its upright position would generally have to be left outside of a garage or other storage building because of its height. Moreover, the base and support structure of portable basketball assemblies often make the assembly very bulky and difficult to store. This limits where the basketball goal assembly can be stored and generally does not allow for storage in traditional places for storage such as an outside shed or garage.

In light of the forgoing, there is a need for a basketball goal assembly that is both portable and foldable for storage.

SUMMARY OF THE INVENTION

Accordingly, the present invention is directed to a portable basketball goal assembly that substantially obviates one or more of the problems arising from the limitations and disadvantages of the related art.

The object and purpose of the present invention is to provide a portable basketball goal assembly that is both easily portable and easily stored.

Additional features and advantages of the invention will be set forth in the description as follows, and in part will be apparent from the description or may be learned by practice of the invention. The objectives and other advantages of the invention will be realized and attained by the methods and apparatus particularly pointed out in the written description and claims hereof together with the appended drawings.

To achieve these and other advantages, and in accordance with the purposes of the invention, as embodied and broadly described, the invention is a portable basketball goal assembly that includes a rim pivotally attached to a backboard which is attached to one end of a shaft containing multiple elements. At least two of the shaft elements are pivotally connected to each other. The other end of the shaft is pivotally attached to the rear end of a base. One end of a shaft support element is pivotally attached to the front end of the base, and the other end of the shaft support element is removably attached to the shaft. The shaft and the shaft support element can be folded towards the base to allow storage and portability of the basketball goal assembly. Moreover, at least two of the shaft elements may be folded upon one another to further reduce the storage space of the assembly.

It is to be understood that both the foregoing general description and the following detailed description are exemplary and explanatory, and are intended to provide further explanation of the invention as claimed.

The accompanying drawings are included to provide a further understanding of the invention and are incorporated in and constitute a part of this specification, illustrating one embodiment of the invention. The drawings, together with the description, serve to explain the principles of the invention.

BRIEF DESCRIPTION OF THE DRAWINGS

The present invention is illustrated by way of example, and not by way of limitation, by the figures of the accompanying drawings in which like reference numerals refer to similar elements, and in which:

FIG. 4 is a partial perspective view of the pivotal connection between the center and lower portions of the shaft of the assembly in FIG. 1.

FIG. 5 is a side perspective view of all attachments at the connection between the center and lower portions of the shaft of the assembly in FIG. 1.

DETAILED DESCRIPTION OF THE INVENTION

Figure 1:
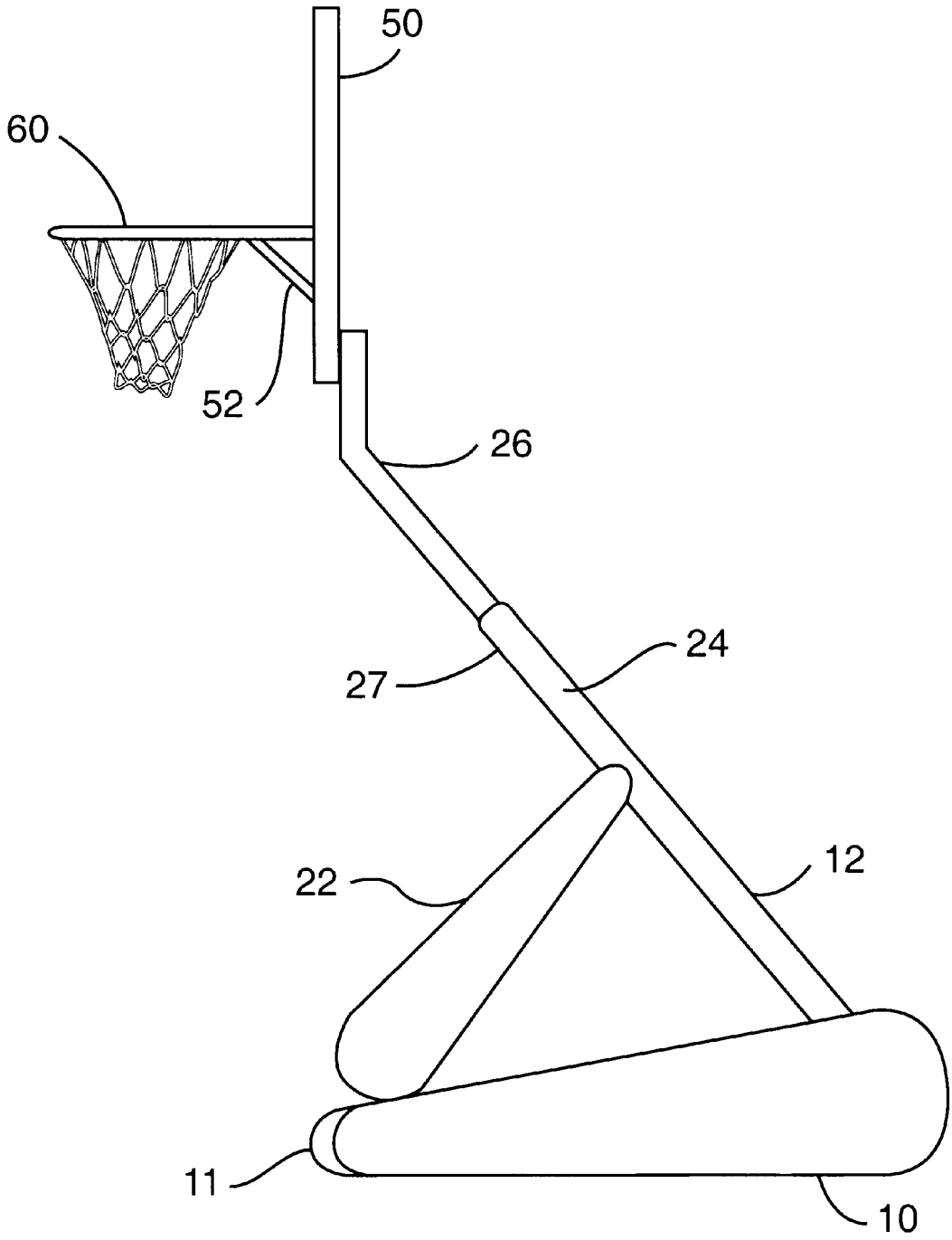
FIG. 1 is a side elevational view of a preferred embodiment of the basketball goal assembly of the present invention in the upright playing position.

Reference will now be made in detail to the present preferred embodiment of the invention, an example of which is illustrated in the accompanying drawings. The exemplary embodiment of the basketball goal assembly of the present invention is shown in FIG. 1, and is designated generally by reference numeral 80. The basketball assembly 80 has a rim 60 attached to a backboard bracket 52. The backboard bracket 52 is attached to the lower portion of a backboard 50. The backboard 50 is attached to one end of upper element 26 of a shaft 27. Preferably, a portion of one end of the upper element 26 of shaft 27 contains an obtuse angle. This allows the backboard 50 to be perpendicular to the playing surface while the shaft 27 is situated at an angle relative to the playing surface. Preferably, the shaft 27 contains three elements, an upper element 26, whose other end is slidably inserted into one end of a middle element 24, whose other end is pivotally connected to one end of a lower element 12. The shaft may, however, contain only two elements pivotally connected to one another, or in excess of two elements with at least two elements pivotally connected.

As shown in FIG. 1, the other end of the lower element 12 of the shaft is pivotally attached, preferably, to the rear end of a base 10. The shaft 27 may, however, be attached to the base at other positions. Nevertheless, preferably, a shaft support element 22 has one end pivotally attached to the front end of base 10. Preferably, one or more wheels 11 are attached to the front end of base 10 to allow for easier movement of the folded basketball goal assembly. In the preferred embodiment two wheels are attached. The other end of shaft support element 22 is removably attached at the connection between middle element 24 of the shaft and lower element 12 of the shaft. The shaft support element 22 may connect with the shaft at any point which allows shaft support element 22 to support the shaft 27. Shaft support element 22 may be a shaft, pole, or any other type of support element, but is preferably a base cover as shown in FIG. 2.

Figure 2:
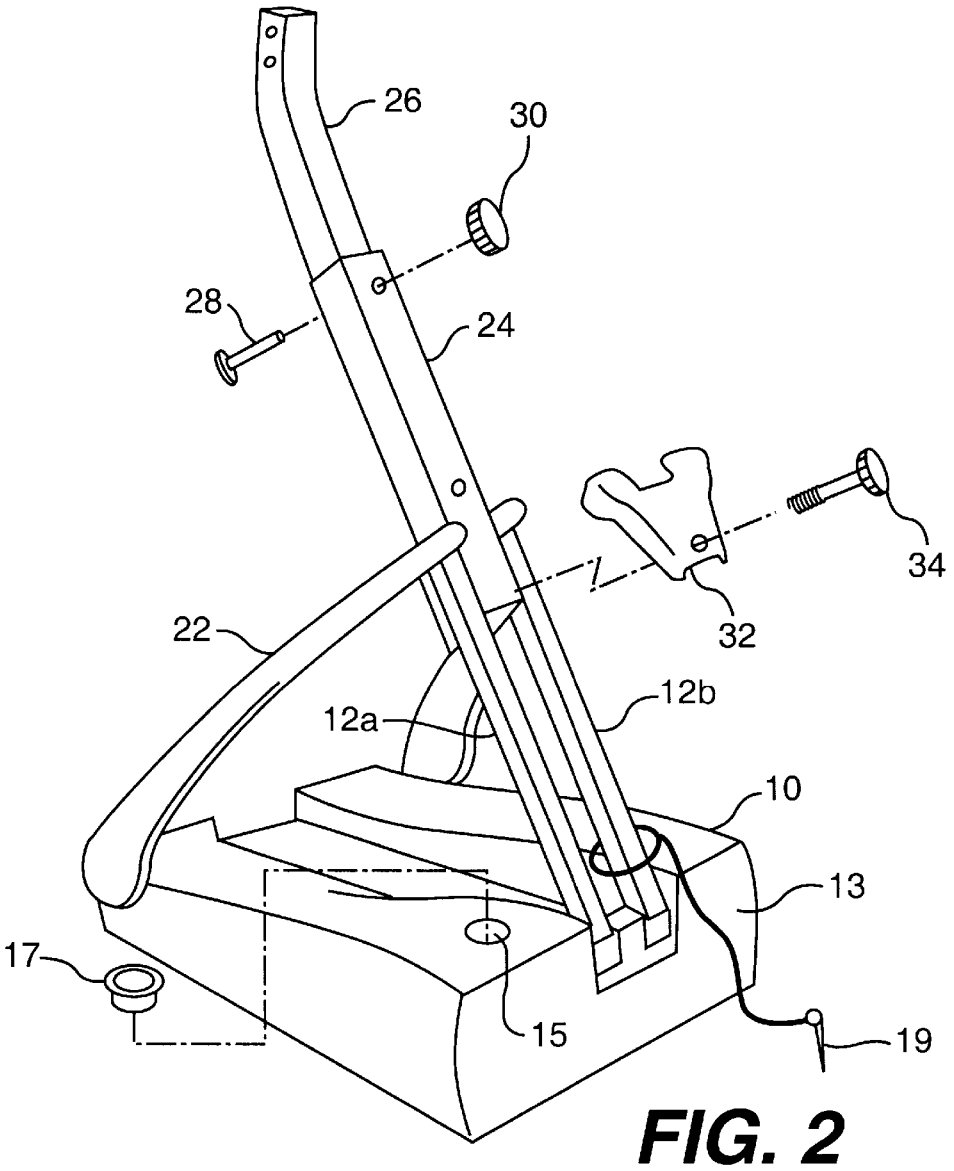
FIG. 2 is a partial perspective view of the lower portion of the assembly of FIG. 1.

FIG. 2 illustrates the base 10, shaft support element 22, middle element 24, and lower element 12 in the upright position. Preferably, base 10 is hollow inside with a hole 15 on top of base 10 that allows base 10 to be filled with a ballast, preferably water or sand, for stability. Cap 17 fits into hole 15. A locking pin 28 is inserted through holes in middle element 24 and through coincident holes in upper element 26. Upper element 26 may have multiple pairs of holes to allow for the height adjustment of the basketball goal assembly. Once a desired height is determined, the pair of holes in upper element 26 associated with this height are aligned to be coincident with the holes in middle element 24 by sliding upper element 26. A knob 30 screws onto locking pin 28, after locking pin 28 has been inserted through the holes in upper element 26 and middle element 24, to lock upper element 26 and middle element 24 in place for the upright playing position of the basketball goal assembly. Although a locking pin and knob is preferred, many other removable locking mechanisms can work. The lower element 12 of the shaft is preferably made up of two parallel legs 12*a* and 12*b*, but may be a single element. Preferably, safety strap 13 is attached to lower element 12 and tied down to an appropriate stationary support for added stability and safety of the basketball assembly. In the preferred embodiment, safety strap 13 is tied down to a stake 19 positioned in the ground.

Figure 3A:
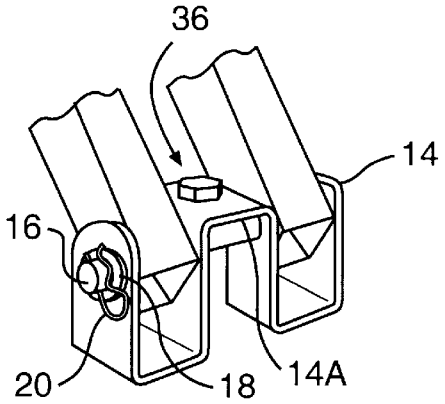
FIG. 3 is a partial perspective view of the bracket mounting the lower shaft to the base of the assembly of FIG. 1.
Figure 3B:
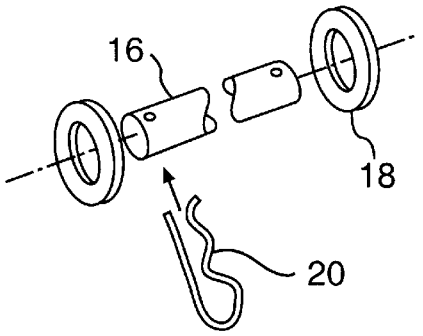

FIG. 3 illustrates the connection of the two lower element legs 12*a* and 12*b* to the base 10. A lower shaft bracket 14 is attached to the top rear end of base 10. Lower shaft bracket 14 is, preferably, shaped like two adjacent "U"s with the adjacent inside legs of each "U" connected together by a cross bar 14A at the top. Lower shaft bracket 14 may, however, be any other shape that supports the lower shaft element and allows for sufficient pivot motion. The cross bar 14A at the top of lower shaft bracket 14 has a weld-nut 36 attached. Lower element legs 12*a* and 12*b* are inserted into the "U"s in lower shaft bracket 14. A pivot pin 16 is inserted through a hole in the outside leg of one "U" of lower shaft bracket 14, through lower element leg 12*a*, through holes in the two adjacent inside legs of the adjacent "U"s of lower shaft bracket 14, through lower element leg 12*b*, and then through a hole in the leg of the other "U" of lower shaft bracket 14. Pivot pin 16 has washers 18 located on the exposed ends of pivot pin 16 on the outside of the "U"s of lower shaft bracket 14. The pivot pin 16 is locked in place by cotter pins 20 inserted through the pivot pin 16 allowing lower element legs 12*a* and 12*b* to pivot around pivot pin 16.

FIG. 4 shows the connection between middle element 24 and lower element legs 12*a* and 12*b*. Middle element 24 is attached between lower element legs 12*a* and 12*b* by a pivot pin 38. Pivot pin 38 is inserted through coincident holes in lower element leg 12*a*, middle element 24, and lower element leg 12*b*. This connection allows middle element 24 and lower element legs 12*a* and 12*b* to pivot around pivot pin 38. Although use of pivot pin 38 is preferred, this connection may also be achieved through other methods that allow a pivotal connection between two elements of the shaft.

FIG. 4 further illustrates that pivot pin 38 has two washers 40, one located on each of the exposed ends of pivot pin 38 on the outside of lower element legs 12*a* and 12*b*. Pivot pin 38 is locked in place, preferably, by two cotter pins 42 inserted through holes in pivot pin 38. Other methods may also be used to lock pivot pin 38 in place.

FIG. 5 illustrates how the shaft support element 22 attaches to pivot pin 38 outside of each of the two cotter pins 42. Preferably, shaft support element 22 has grooves 39 that fit over, and rest on top of, pivot pin 38. When the basketball backboard assembly is in the upright playing position, the middle element 24 and lower element legs 12*a* and 12*b* are locked in place and prevented from rotating. Positioned on one side of, and near the bottom of the end of middle element 24 that attaches to lower element legs 12*a* and 12*b*, is a weld-nut 42 which is attached to a bracket 44. This bracket 44 is attached at the lower end of middle element 24. Preferably, a bolt 34, with a knob to allow rotation by hand, is inserted through a hole in a shell 32 that fits over the connection between middle element 24 and lower element legs 12*a* and 12*b*, and over the connection of shaft support element 22 and pivot pin 38. The bolt 34 extends through shell 32, middle element 24, bracket 44, and then screws into weld-nut 42. When shell 32 is securely screwed down into weld-nut 42 by bolt 34, middle element 24 and lower element legs 12*a* and 12*b* are locked into their upright playing positions. Shaft support element 22 is also locked into place and prevented from becoming disconnected from connection with pivot pin 38 when shell 32 is securely screwed down. Preferably, secure middle element 24, lower element legs 12*a* and 12*b*, and shaft support element 22 are secured by shell 32 and bolt 34, but other methods may also be used.

Figure 6:
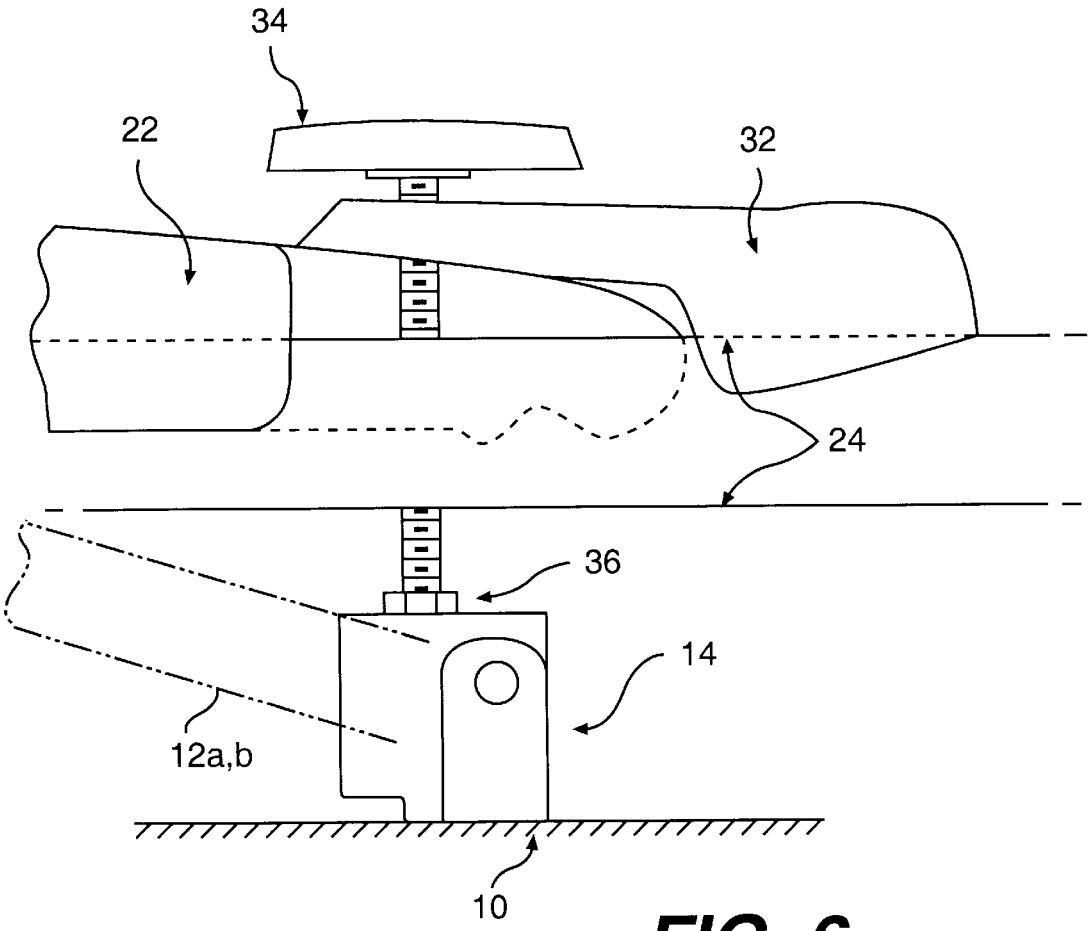
FIG. 6 is a side elevational view of the base of the assembly in FIG. 1 in the storage position.
Figure 7:
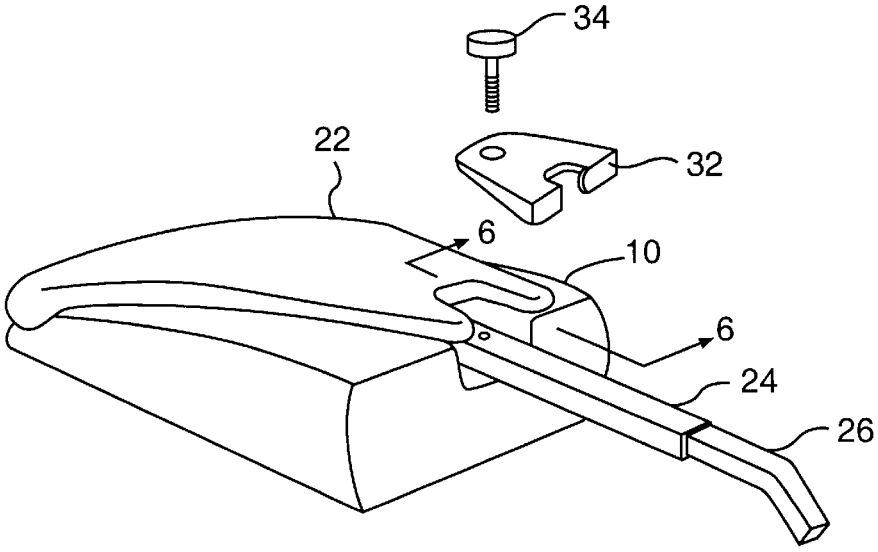
FIG. 7 is a perspective view of the base of the assembly in FIG. 1 in the storage position.

FIG. 6 and FIG. 7 illustrate the base 10, lower element legs 12*a* and 12*b*, middle element 24, shell 32, bolt 34, and shaft support element 22 when the basketball goal assembly is in the folded storage position. The basketball backboard assembly is folded into its storage position by first lowering the backboard 50 and then unscrewing bolt 34 and removing shell 32. Preferably, the backboard 50 is lowered to approximately 7.5 feet by sliding upper element 26 into middle element 24. Once shell 32 is removed, middle element 24 can be rotated about pivot pin 38 such that middle element 24 moves in a direction away from shaft support element 22 and towards being parallel to lower element legs 12*a* and 12*b*. Lower element legs 12*a* and 12*b* pivot around pivot pin 16 in a direction towards base 10 until lower element legs 12*a* and 12*b* rest on top of base 10.

Middle element 24 then rests on top of base 10 between the two parallel lower element legs 12*a* and 12*b*. Locking pin 28 is removed from knob 30 allowing upper element 26 to be moved to its lowest position towards middle element

24. Shaft support element 22 is folded towards base 10 until shaft support element 22, preferably, covers lower element legs 12*a* and 12*b* and the portion of middle element 24 that lies on base 10. Preferably, base 10 is provided with cavities for receiving the shaft support element 22 and the shaft 27. Preferably, shell 32 is placed over shaft support element 22 and secured by inserting bolt 34 through a hole in middle element 24, through a hole in upper element 26, and into weld-nut 36 located on lower shaft bracket 14 attached to base 10. Bolt 34 is tightened which secures shell 32, shaft support element 22, middle element 24, and lower element legs 12*a* and 12*b* to base 10 for storage.

Figure 8:
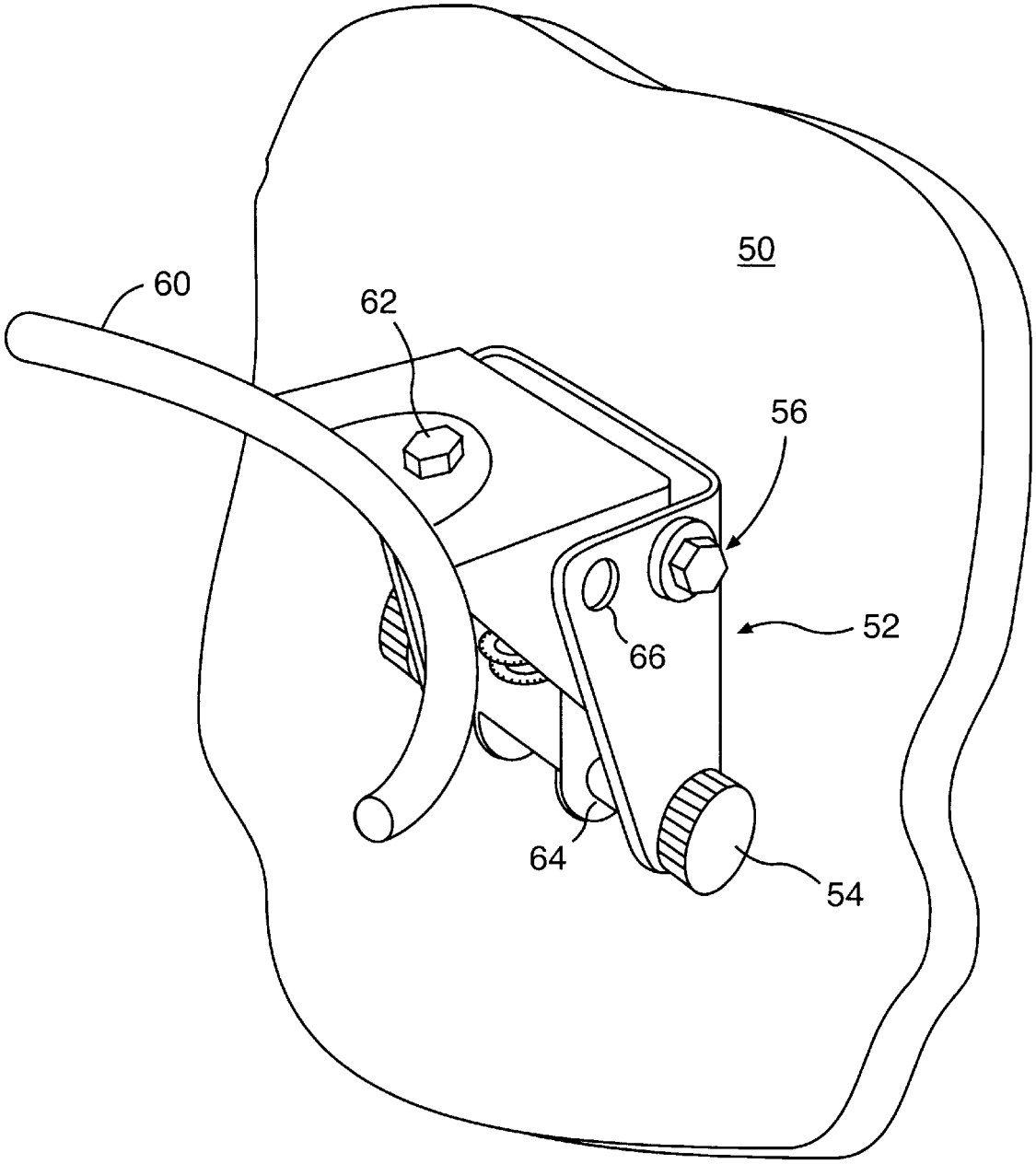
FIG. 8 is a perspective view of the basketball rim of the assembly of FIG. 1 in the playing position.
Figure 9:
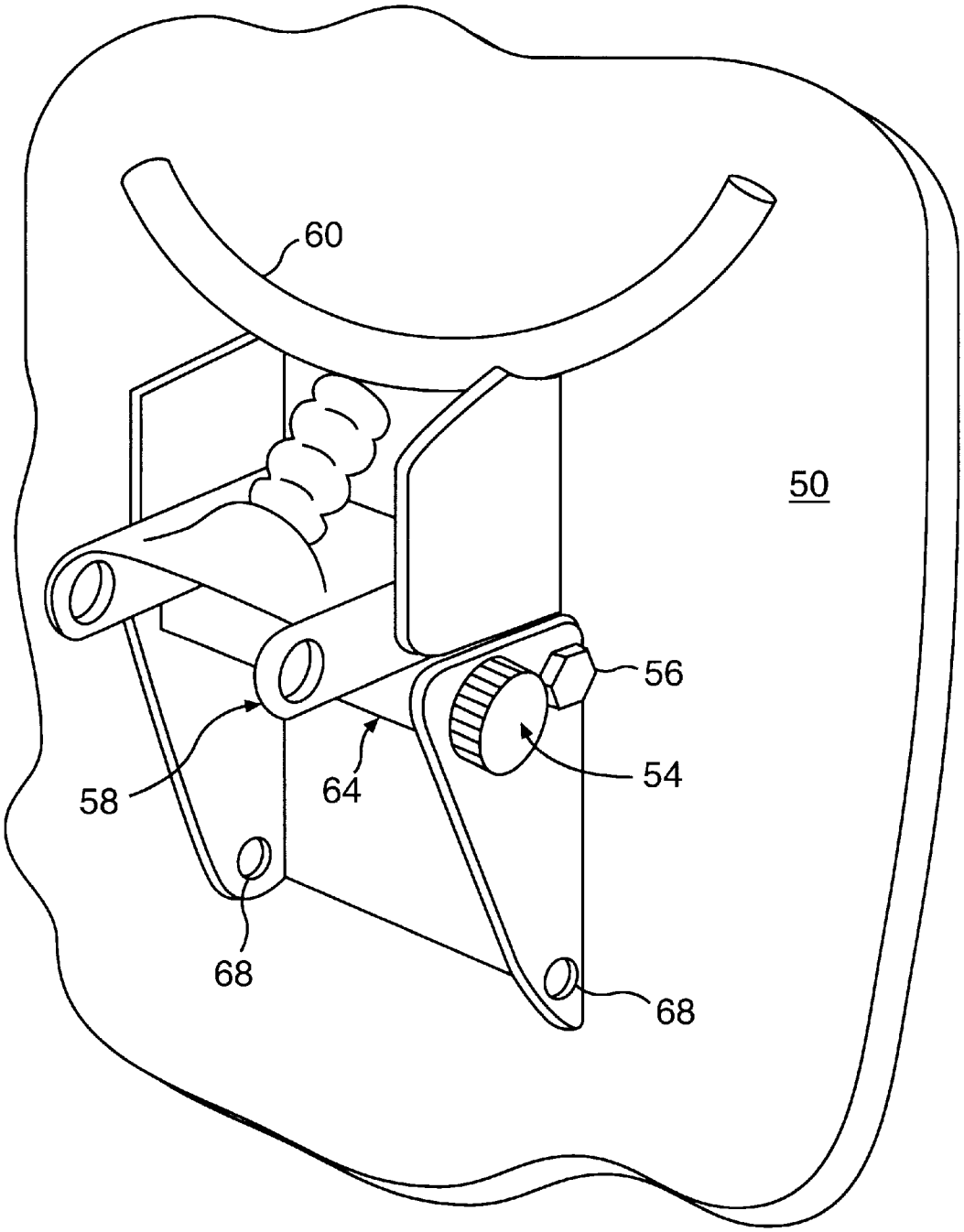
FIG. 9 is a perspective view of the basketball rim of the assembly of FIG. 1 in the storage position.

FIG. 8 and FIG. 9 illustrate the playing position and the storage position respectively for the basketball rim 60. Basketball rim 60 is, preferably, connected to a spring assembly 58 by bolt 62. Spring assembly 58 is pivotally attached to lower backboard bracket 52 by hinge element 56. Spring assembly 58 allows basketball rim 60 to spring back to its playing position after receiving a temporary downward force, such as a player grabbing or hanging on the basketball rim 60.

In the playing position, spring assembly 58, and attached basketball rim 60, are preferably locked in placed by two knobs 54 and spacer assembly 64. Spacer assembly 64 fits through two holes in spring assembly 58, and then through two holes 66 in lower bracket 52 that are coincident and on the outside of the holes in spring assembly 58. Knobs 54 are then attached to each end of spacer assembly 64. This secures spacer assembly 64 and locks spring assembly 58 and basketball rim 60 into the playing position.

In the storage position, the two knobs 54 are removed from the ends of spacer assembly 64 and spacer assembly 64 is removed from the holes in spring assembly 58. Spring assembly 58 then pivots such that basketball rim 60 moves in a direction towards and parallel to basketball backboard 50. Basketball rim 60 and spring assembly 58 are locked into this storage position by, preferably, inserting spacer assembly 64 through an alternative set of holes 68 in lower backboard bracket 52, and attaching knobs 54 to the ends of spacer assembly 64 that protrude from the holes in lower backboard bracket 52. The present invention may, however, be used without the spring assembly 58. Moreover, the spirit and scope of the present invention will not be lost if the basketball rim 60 is not foldable towards the basketball backboard 50, but instead remains in the playing position.

The basketball goal assembly in the folded storage position of FIGS. 6 and 7 can be moved to a storage location using wheels 11. The basketball goal assembly in the folded storage position can be stored in either an upright position against a wall with base 10 in the vertical plane, or in a horizontal position with base 10 in the horizontal plane parallel to the ground.

It will be apparent to those skilled in the art that various modifications and variations can be made in the foldable basketball assembly of the present invention without departing from the spirit and scope of the invention. Thus, it is intended that the present invention cover modifications and variations of this invention provided they come within the scope of the appended claims and their equivalents.

What is claimed is:

1. A foldable basketball goal assembly comprising:

a base with a front end and a back end;

a shaft comprising a first element having a first end and a second end and a second element having a first end and a second end, wherein the second end of the first element of said shaft is pivotally connected to the first end of the second element of said shaft;

a shaft support element having a first end and a second end, the first end of said shaft support element being pivotally attached to the front end of said base, and the second end of said shaft support element being removably attached to at least one of the first element of said shaft and the second element of said shaft;

a basketball backboard attached to the first end of the first element of said shaft; and a basketball rim attached to said basketball backboard, wherein some of said basketball goal assembly is foldable towards said base.

2. The basketball goal assembly recited in claim 1 wherein a portion of the first end of the first element of said shaft contains an obtuse angle before said basketball backboard attachment.

3. The basketball goal assembly recited in claim 1 further comprising a brace for removably attaching the second end of said shaft support element to at least one of the first element of said shaft and the second element of said shaft.

4. The basketball goal assembly recited in claim 3 wherein said brace comprises a shell and a bolt.

5. The basketball goal assembly recited in claim 1 wherein said basketball rim is foldable towards said basketball backboard.

6. The basketball goal assembly recited in claim 5 wherein said basketball rim further comprises a spring assembly pivotally attached to a backboard bracket, said backboard bracket attached to said basketball backboard, wherein said spring assembly causes said basketball rim to spring back to the playing position after said basketball rim receives a temporary downward force.

7. The basketball goal assembly recited in claim 1 wherein said shaft support element, the first element of said shaft, and the second element of said shaft are foldable towards said base.

8. The basketball goal assembly recited in claim 7 wherein said base includes cavities for receiving said shaft support element, the first element of said shaft, and the second element of said shaft when said shaft support element, the first element of said shaft, and the second element of said shaft are folded towards said base.

9. A foldable basketball goal assembly comprising:

a base with a front end and a back end;

a shaft comprising a first element having a first end and a second end, a second element having a first end and a second end, and a third element having a first end and a second end, wherein the second end of the first element is slidable inside the first end of the second element, and the second end of the second element is pivotally attached to the first end of the third element;

a shaft support element having a first end and a second end, the first end of said shaft support element being pivotally attached to the front end of said base, and the second end of said shaft support element being removably attached to at least one of the second element of said shaft and the third element of said shaft;

a basketball backboard attached to the first end of the first element of said shaft; and a basketball rim attached to said basketball backboard, wherein some of said basketball goal assembly is foldable towards said base.

10. The basketball goal assembly recited in claim 9 wherein said first element of said shaft is removable from said second element of said shaft.

11. The basketball goal assembly recited in claims 1 or 9 further comprising a latching mechanism for locking a portion of said first element inside of said second element.

12. The basketball goal assembly recited in claim 9 further comprising a brace for removably attaching the second end of said shaft support element to at least one of the second element of said shaft and the third element of said shaft.

13. The basketball goal assembly recited in claim 12 wherein said brace comprises a shell and a bolt.

14. The basketball goal assembly recited in claim 9 wherein said basketball rim is foldable towards said basketball backboard.

15. The basketball goal assembly recited in claim 9 wherein said shaft support element, the second element of said shaft, and the third element of said shaft are foldable towards said base.

16. The basketball goal assembly recited in claim 9 wherein said base includes cavities for receiving said shaft support element, the second element of said shaft, and the third element of said shaft when said shaft support element, the second element of said shaft, and the third element of said shaft are folded towards said base.

17. The basketball goal assembly recited in claim 1 wherein said base includes one or more wheels attached to the front end of said base.

18. The basketball goal assembly recited in claim 1 wherein said assembly further comprises a removable strap attached from said shaft to a stationary support.

19. The basketball goal assembly recited in claim 1 wherein said base is hollow, and may be filled with a ballast for stability.

20. The basketball goal assembly recited in claim 19 wherein the ballast is water.

21. The basketball goal assembly recited in claim 19 wherein the ballast is sand.

22. The basketball goal assembly recited in claim 1 wherein said base is hollow, and may be filled with sand for stability.

23. The basketball goal assembly recited in claim 1 wherein said assembly may be stored in a horizontal position parallel to the ground.

24. The basketball goal assembly recited in claim 1 wherein said assembly may be stored in an upright position perpendicular to the ground.

25. The basketball goal assembly recited in claim 9 wherein said base includes one or more wheels attached to the front end of said base.

26. The basketball goal assembly recited in claim 25 wherein when the goal assembly is folded towards the base, the assembly is transportable by the one or more wheels.

27. The basketball goal assembly recited in claim 9 wherein said assembly further comprises a removable strap attached from said shaft to a stationary support.

28. The basketball goal assembly recited in claim 9 wherein said base is hollow, and may be filled with a ballast for stability.

29. The basketball goal assembly recited in claim 28 wherein the ballast is water.

30. The basketball goal assembly recited in claim 28 wherein the ballast is sand.

31. The basketball goal assembly recited in claim 9 wherein said base is hollow, and may be filled with sand for stability.

32. The basketball goal assembly recited in claim 9 wherein said assembly may be stored in a horizontal position parallel to the ground.

33. The basketball goal assembly recited in claim 9 wherein said assembly may be stored in an upright position perpendicular to the ground.

* * * * *